US005458037A

United States Patent [19]

Harman

[11] Patent Number: 5,458,037

[45] Date of Patent: Oct. 17, 1995

[54] PERCUSSIVE SPOON INSTRUMENT

[76] Inventor: Michael W. Harman, 4405 Meriwether Dr., Boise, Id. 83705

[21] Appl. No.: 323,747

[22] Filed: Oct. 17, 1994

[51] Int. Cl.[6] ..... G10D 13/08

[52] U.S. Cl. ..... 84/402

[58] Field of Search ..... 84/402, 409, 410

[56] References Cited

U.S. PATENT DOCUMENTS

| | | | |
|---|---|---|---|
| 823,713 | 6/1906 | Chein | 84/402 |
| 2,848,839 | 4/1955 | Haines | 84/402 X |

*Primary Examiner*—Steven L. Stephan
*Assistant Examiner*—Patrick J. Stanzione

[57] ABSTRACT

An instrument for generating a percussive audio sound for resonation within an individual's mouth cavity. The inventive device includes a spoon member having a spoon head positionable proximal to the mouth of the individual. A hammer assembly is coupled to the spoon member and positioned so as to strike a back surface of the spoon to generate a percussive audio sound directed into the individual's mouth. An alteration of the volume of the individual's mouth can then be made to manipulate the tone of the sound generated by the device.

13 Claims, 5 Drawing Sheets

PERCUSSIVE SPOON INSTRUMENT

BACKGROUND OF THE INVENTION

1. Field of the Invention

The present invention relates to percussion devices and more particularly pertains to a percussive spoon instrument for generating a percussive audio sound for resonation within an individual's mouth cavity.

2. Description of the Prior Art

The use of percussion devices is known in the prior art. More specifically, percussion devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art percussion devices include U.S. Pat. No. Des., 260,655; U.S. Pat. No. 3,444,772; U.S. Pat. No. 4,976,651; U.S. Pat. No. 3,499,361; and U.S. Pat. No. Des., 318,695.

While these devices fulfill their respective, particular objectives and requirements, the aforementioned patents do not disclose a percussive spoon instrument for generating a percussive audio sound for resonation within an individual's mouth cavity which includes a spoon member having a spoon head positionable proximal to the mouth of the individual, and a hammer assembly coupled to the spoon member and positioned so as to strike a back side of the spoon to generate a percussive audio sound directed into the individual's mouth.

In these respects, the percussive spoon instrument according to the present invention substantially departs from the conventional concepts and designs of the prior art, and in so doing provides an apparatus primarily developed for the purpose of generating a percussive audio sound for resonation within a individual's mouth cavity.

SUMMARY OF THE INVENTION

In view of the foregoing disadvantages inherent in the known types of percussion devices now present in the prior art, the present invention provides a new percussive spoon instrument construction wherein the same can be utilized for generating a percussive audio sound for resonation within an individual's mouth cavity. As such, the general purpose of the present invention, which will be described subsequently in greater detail, is to provide a new percussive spoon instrument apparatus and method which has many of the advantages of the percussion devices mentioned heretofore and many novel features that result in a percussive spoon instrument which is not anticipated, rendered obvious, suggested, or even implied by any of the prior art percussion devices, either alone or in any combination thereof.

To attain this, the present invention generally comprises an instrument for generating a percussive audio sound for resonation within an individual's mouth cavity. The inventive device includes a spoon member having a spoon head positionable proximal to the mouth of the individual. A hammer assembly is coupled to the spoon member and positioned so as to strike a back surface of the spoon to generate a percussive audio sound directed into the individual's mouth. An alteration of the volume of the individual's mouth can then be made to manipulate the tone of the sound generated by the device.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new percussive spoon instrument apparatus and method which has many of the advantages of the percussion devices mentioned heretofore and many novel features that result in a percussive spoon instrument which is not anticipated, rendered obvious, suggested, or even implied by any of the prior art percussion devices, either alone or in any combination thereof.

It is another object of the present invention to provide a new percussive spoon instrument which may be easily and efficiently manufactured and marketed.

It is a further object of the present invention to provide a new percussive spoon instrument which is of a durable and reliable construction.

An even further object of the present invention is to provide a new percussive spoon instrument which is susceptible of a low cost of manufacture with regard to both materials and labor, and which accordingly is then susceptible of low prices of sale to the consuming public, thereby making such percussive spoon instruments economically available to the buying public.

Still yet another object of the present invention is to provide a new percussive spoon instrument which provides in the apparatuses and methods of the prior art some of the advantages thereof, while simultaneously overcoming some of the disadvantages normally associated therewith.

Still another object of the present invention is to provide a new percussive spoon instrument for generating a percussive audio sound for resonation within a mouth cavity of an individual.

Yet another object of the present invention is to provide a new percussive spoon instrument which includes a spoon member having a spoon head positionable proximal to the mouth of the individual, and a hammer assembly coupled to the spoon member and positioned so as to strike a back side of the spoon to generate a percussive audio sound directed into the individual's mouth.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
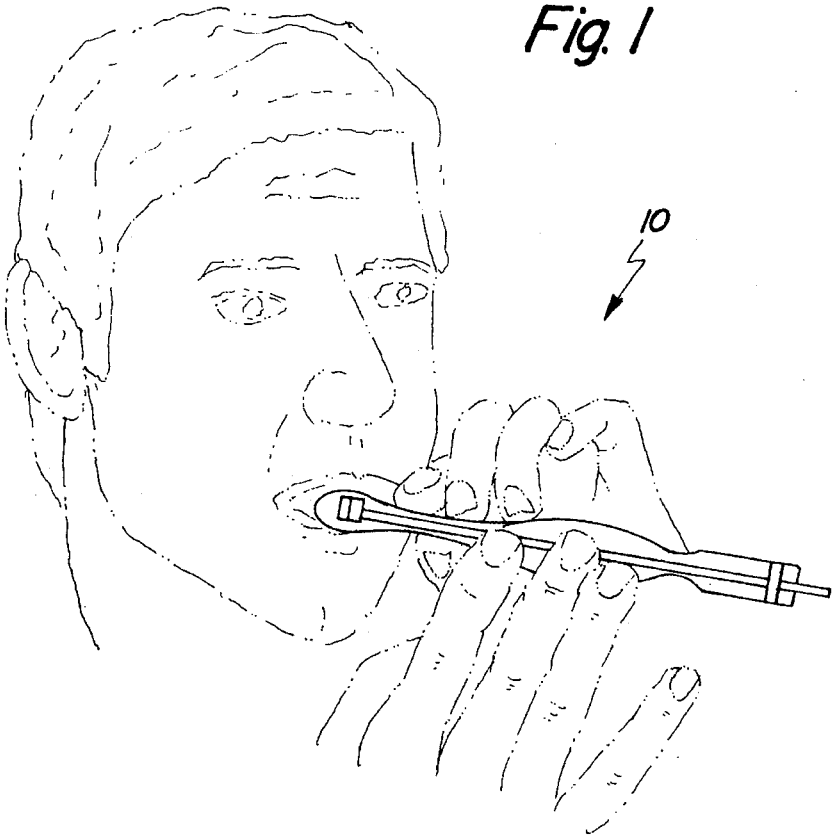
FIG. 1 is a isometric illustration of a percussive spoon instrument according the present invention in use.

With reference now to the drawings, and in particular to FIGS. 1–15 thereof, a new percussive spoon instrument embodying the principles and concepts of the present invention and generally designated by the reference numeral 10 will be described.

Figure 3:
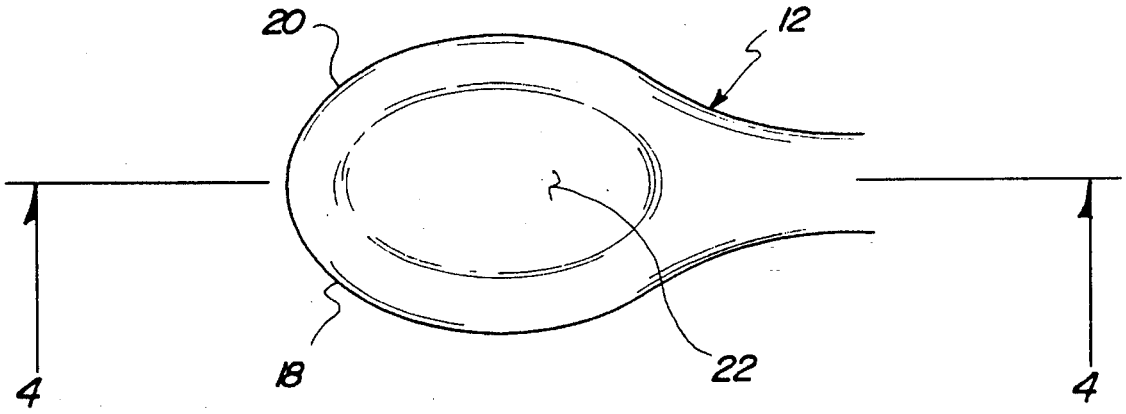
FIG. 3 is a bottom plan view of a portion of the invention.

More specifically, it will be noted that the percussive spoon instrument 10 comprises an elongated spoon member 12 having an elongated handle 14 which can be grasped and manipulated by an individual 16 during use of the device 10. The spoon member 12 further includes a spoon head 18 integrally or otherwise fixedly secured to a first end of the elongated handle 14. The spoon head 18 has a substantially ellipsoidal shape defined by an ellipsoidal perimeter 20 extending thereabout as shown in FIG. 3. The spoon head 18 is shaped so as to define a spoon head cavity 22, as well as a longitudinal ridge 24 extending along a back side thereof. The longitudinal ridge 24 is oriented so as to extend substantially parallel to a longitudinal axis extending through the elongated handle 14 and faces in a direction opposite that of the spoon head cavity 22.

Figure 2:
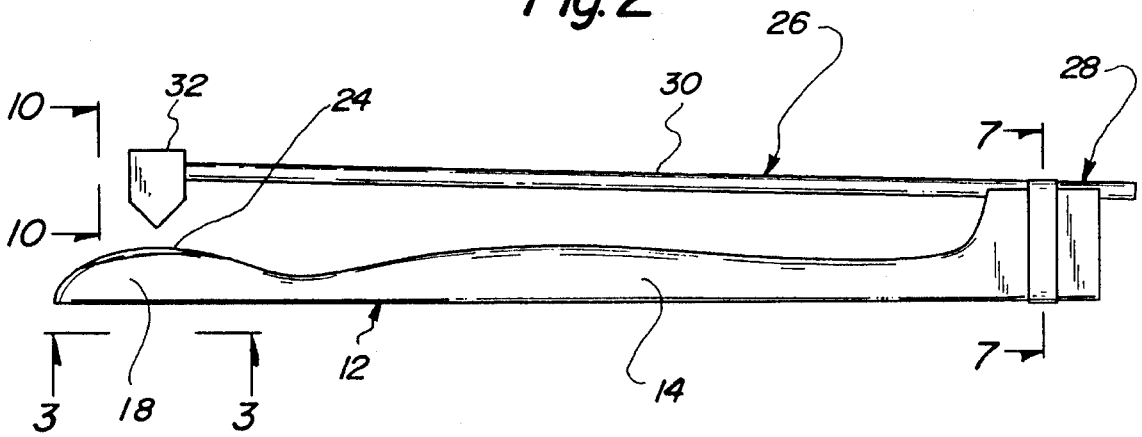
FIG. 2 is a side elevation view thereof.

As shown in FIG. 2, a hammer assembly 26 is mounted to a second end of the elongated handle 14 of the spoon member 12 by a mounting means 28. The hammer assembly 26 comprises a reed arm 30 mounted at a first end thereof by the mounting means 28 to the second end of the elongated handle 14. The reed arm 30 extends along a longitudinal length of the elongated handle 14 and terminates at a second end positioned proximal to the longitudinal ridge 24 of the spoon head 18 whereat a hammer head 32 is mounted to the second end thereof. The hammer head 32 is positioned so as to reside in a spaced relationship relative to the longitudinal ridge 24 of the spoon head 18, whereby an individual can resiliently deform the reed arm 30 to effect impacting of the hammer head 32 against the longitudinal ridge 24 to generate a percussive sound radiated from the spoon head cavity 22 and into the individual's mouth when the device 10 is positioned as shown in FIG. 1. By this structure, a tapping of the reed arm 30 causing the hammer head 32 to impact the longitudinal ridge 24 will generate percussive audio, whereby an alteration of the volume of the individual's mouth can effect variations in tone of such audio sound.

Figure 4:
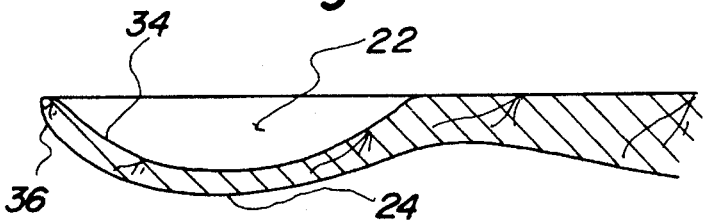
FIG. 4 is a cross sectional view taken along line 4—4 of FIG. 3.
Figure 5:
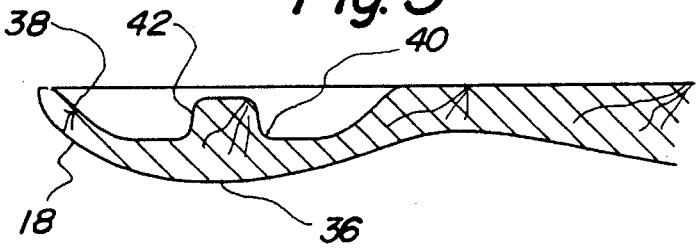
FIG. 5 is a cross sectional view of an alternative spoon head shape.
Figure 6:
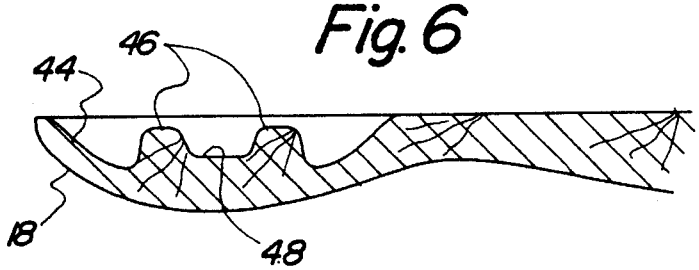
FIG. 6 is a cross sectional view of a further alternative spoon head shape.

Turning now to FIGS. 4–6, it can be shown that the spoon head 18 of the present invention 10 may comprise a variety of shapes. In this connection, the spoon head 18 as shown in FIG. 4, is defined as having a concave interior surface 34 spaced from a convex exterior surface 36 with the longitudinal ridge 24 extending along and projecting from the convex exterior surface. As shown in FIG. 5, the spoon head 18 may alternatively be defined as having a concave interior surface 38 continuing into a flat interior surface 40 from which a center projection 42 extends. In this configuration, the longitudinal ridge 24 similarly extends from the convex exterior surface 36. As shown in FIG. 6, the spoon head 18 may take a further alternative shape defined by a concave interior surface 44 from which a pair of eccentric projections 46 extend with a raised center interior surface 48 extending between the eccentric projections. In a manner similar to the spoon heads 18 illustrated in FIGS. 4 and 5, the further alternative shape illustrated in FIG. 6 also includes the longitudinal ridge 24 extending along the convex exterior surface 36. These alternative spoon heads 18 each result in a different radiation of the percussion sound generated by the impacting of the hammer head 32 against the longitudinal ridge 24 from the spoon member 12. In other words, the variety of shapes illustrated in FIGS. 4–6 provides for a variation in the richness of sound quality generated by the device 10.

Figure 7:
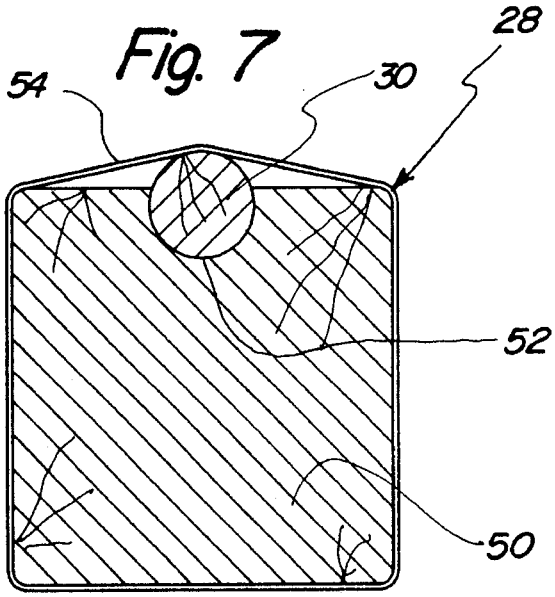
FIG. 7 is a cross sectional view taken along line 7—7 of FIG. 2.
Figure 8:
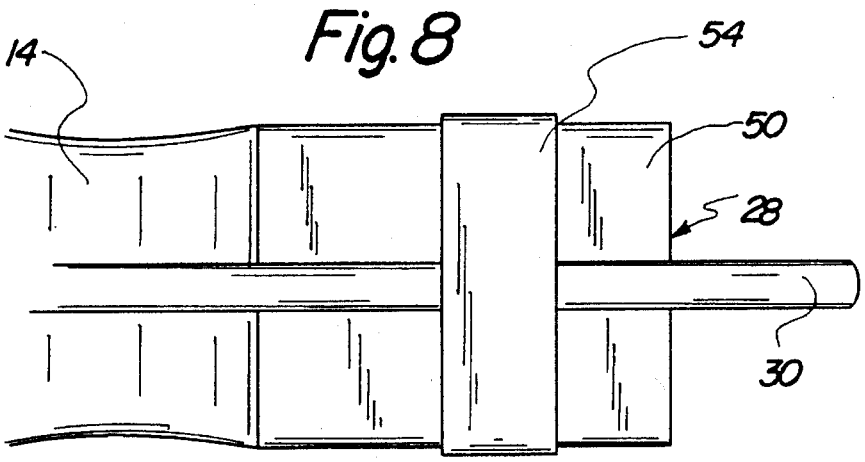
FIG. 8 is a top plan view of a mounting means of the present invention.
Figure 9:
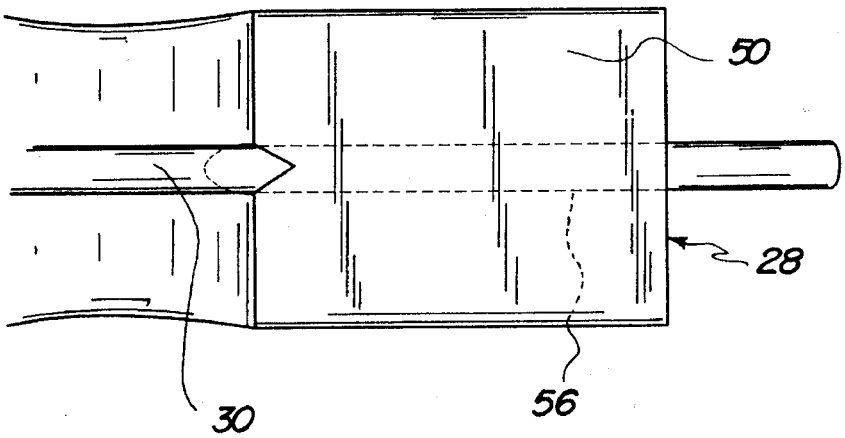
FIG. 9 is a top plan view of an alternative mounting means of the present invention.
Figure 10:
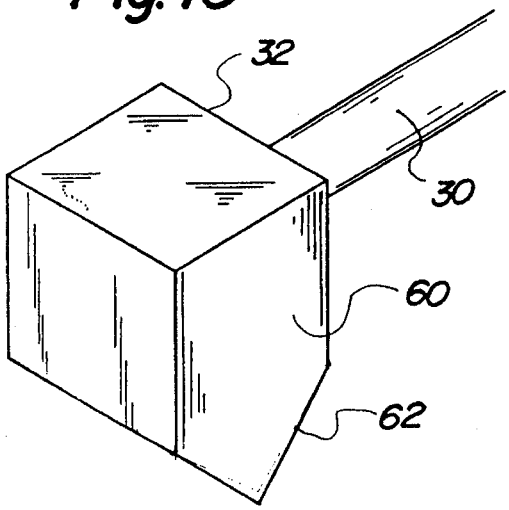
FIG. 10 is isometric illustration of a hammer head forming a portion of the present invention.

Referring now to FIGS. 7–9 wherein the mounting means 28 of the present invention 10 is illustrated in detail, it can be shown that the mounting means disclosed herein preferably comprises a mounting block 50 integrally or otherwise fixedly secured to the second end of the elongated handle 14. A semi-circular channel 52 extends along a top surface of the mounting block 50 in a direction parallel to the longitudinal axis of the elongated handle 14 and is dimensioned so as to receive a first end of the reed arm 30 at least partially therewithin. An elastic band 54 extending about the mounting block 50 serves to retain the reed arm 30 relative to the mounting block and may additionally impart elasticity to the mounting of the reed arm 30 relative to the elongated handle 14. In other words, the reed arm 30, depending upon the resiliency of the elastic band 54, can be permitted to pivot from the semi-circular channel 52 if so desired. However, the elastic band 54 is typically tightly placed about the mounting block 50 so as to preclude such resilient pivoting of the reed arm 30 relative to the mounting block. Preferably, the semi-circular channel 52 extends along a top surface of the mounting block 50, as shown in FIG. 8. However, the mounting means 28 of the present invention 10 may alternatively comprise a circular aperture 56 directed through the mounting block 50, wherein an interference fit between the first end of the reed arm 30 and the interior surfaces of the circular aperture 56 eliminates a need for the elastic band 54 extending about the mounting block 50. In other words, the circular aperture 56 can be sized so as to frictionally engage in exterior surface of the first end of the reed arm 30 to removably retain the reed arm 30 within the mounting means 28.

Figure 11:
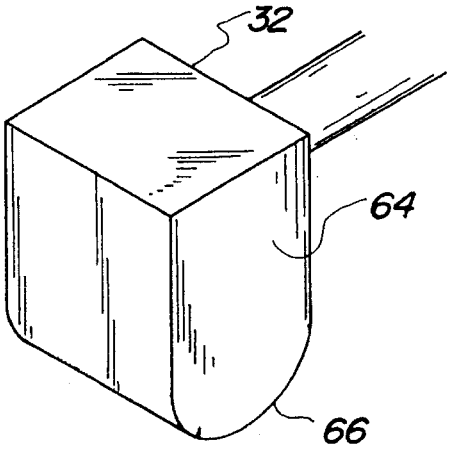
FIG. 11 is an isometric illustration of an alternative hammer head shape.
Figure 12:
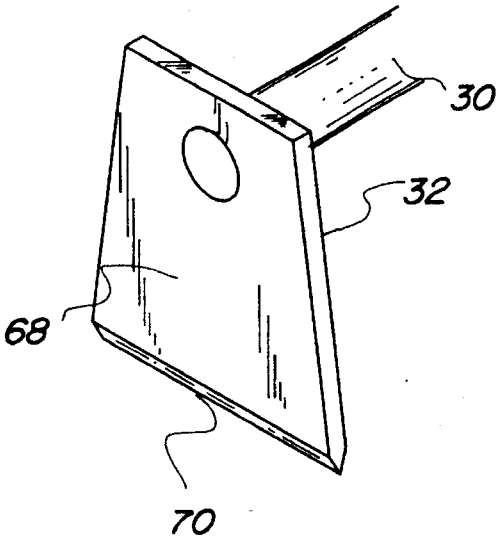
FIG. 12 is an isometric illustration of a further alternative hammer head shape.
Figure 13:
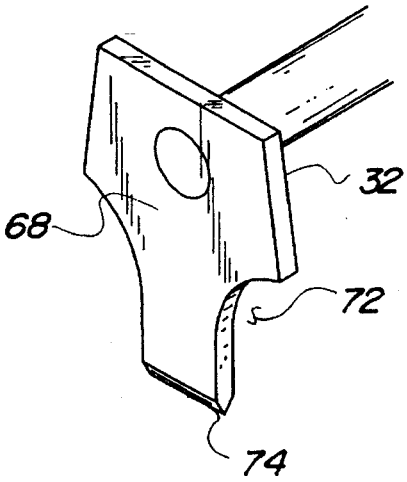
FIG. 13 is an isometric illustration of another further alternative hammer head shape.

The hammer head 32 includes an unlabeled striking tip which impacts the longitudinal ridge 24 of the spoon head 18 to generate a percussive audio sound. The tip of the hammer head 32 is preferably oriented orthogonal to the extent of the longitudinal ridge 24, as shown in FIG. 2. Referring now to FIGS. 10–13, it can be shown that the hammer head 32 may take a variety of shapes. In this connection, the hammer head 32 shown in FIG. 10 comprises a substantially rectangular block 60 shaped so as to define an angled tip 62 extending substantially orthogonal to a longitudinal axis of the reed arm 30. As shown in FIG. 11, the hammer head 32 may alternatively comprise a block 64 shaped so as to define a semi-circular tip 66. FIG. 12 illustrates that the hammer head 32 may take form of a blade 68 coupled to the second end of the reed arm 30 and shaped so as to define an elongated sharp edge 70 positioned to engage the longitudinal ridge 24 of spoon head 18. As shown in FIG. 13, the blade 68 of an alternative form of the hammer head 32 may include a pair of opposed arcuate cutouts 72 which cooperate to define a shortened sharp edge 74 along a portion of the blade.

Figure 14:
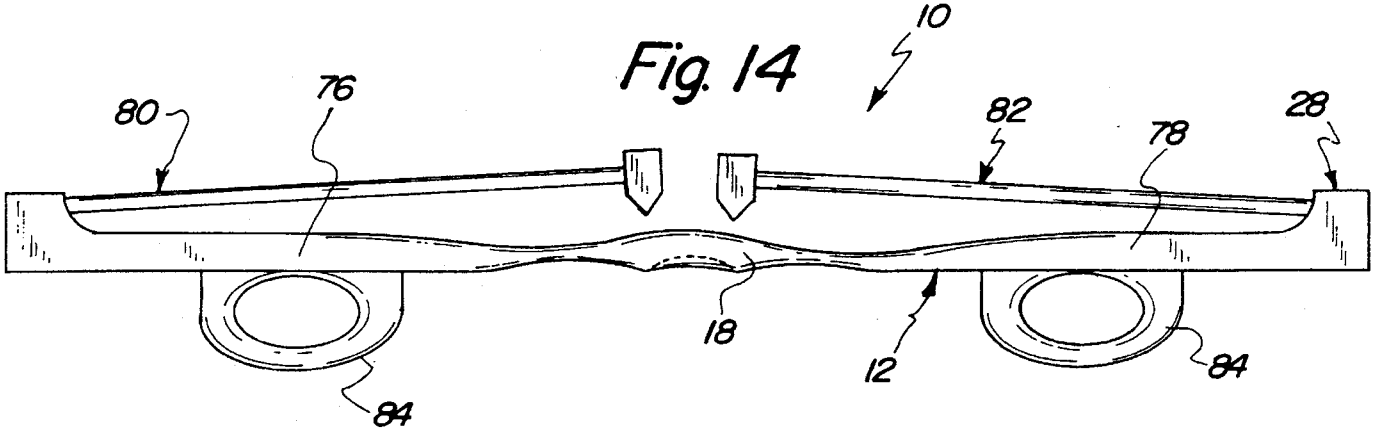
FIG. 14 is a side elevation view of an alternative form of the present invention.

FIG. 14 illustrates an alternative form of the spoon member 12, wherein a first elongated handle 76 extends from the spoon head 18 in a first direction, and a second elongated handle 78 extends from the spoon head in a second direction. Preferably, the elongated handles 76, 78 are positioned in a colinear orientation and project in opposed directions. In this alternative form of the present invention 10, mounting means 28 are provided at the outer ends of the elongated handles 76, 78 for mounting respective hammer assemblies 80, 82 relative thereto. In other words, a first hammer assembly 80 is coupled to an outer end of the first elongated handle 76 by a mounting means 28, with a second hammer assembly 82 being coupled to an outer end of the second elongated handle 78 by a further mounting means 28. In this form of the present invention, it is desirable to include a pair of thumb loops 84, with each thumb loop being coupled to an individual one of the elongated handles 76, 78 as shown in FIG. 14. By this structure, percussive audio sounds can be generated with increased frequency through the double hammer assemblies provided.

Figure 15:
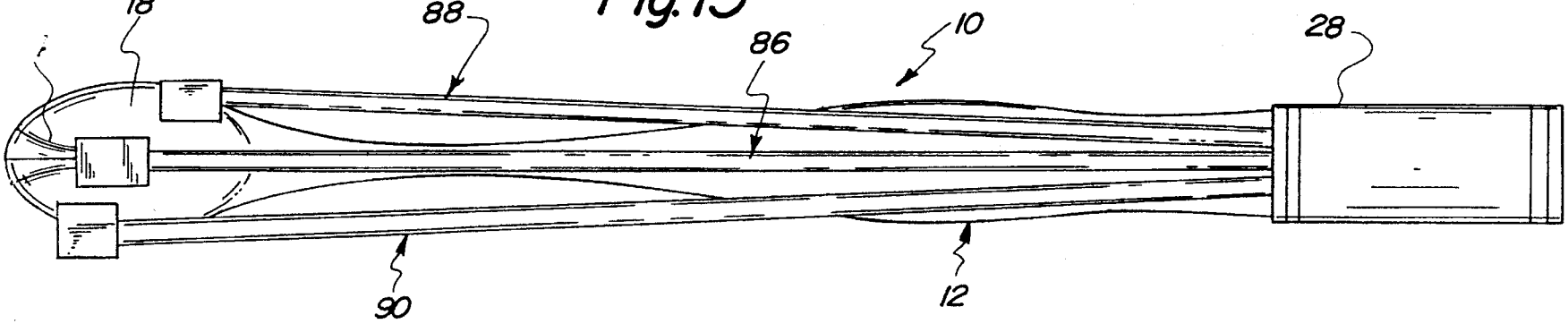
FIG. 15 is a top plan view of a further alternative form of the present invention.

FIG. 15 is a top plan view of a further alternative form of the present invention 10 and it can be shown from this figure that the mounting means 28 can include a plurality of through-extending apertures in the form of the semi-circular channels illustrated in FIG. 7, or alternatively, in the form of the circular apertures 56 illustrated in FIG. 9. In this configuration, the mounting means 28 is operable to mount a plurality of hammer assemblies including a center hammer assembly 86 extending along the spoon member 12 and including a hammer head 32 positioned for impacting against the longitudinal ridge 24 of the spoon head 18, as well as a first lateral hammer assembly 88 and a second lateral hammer assembly 90 extending substantially parallel to and along opposed sides of the center hammer assembly 86. The first and second lateral hammer assemblies 88 and 90 are positioned so as to impact the spoon head 18 on respectively opposed sides of the longitudinal ridge 24 thereof. Alternatively, the lateral hammer assemblies can be positioned to impact the longitudinal ridge 24, as desired. Preferably, the center hammer assembly 86 is of a first longitudinal length, with the first lateral hammer assembly 88 being of a second longitudinal length wherein the first longitudinal length is substantially greater than the second longitudinal length. Moreover, it is preferable that the second lateral hammer assembly 90 be of a third longitudinal length, wherein the third longitudinal length is substantially greater than the first longitudinal length of the center hammer assembly 86. By this structure, any one of the hammer assemblies 86–90 can be individually operated or impacted against the spoon head 18 to create a variety of percussive audio sounds radiated from the spoon head.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A percussive spoon instrument comprising:

an elongated spoon member, said spoon member comprises an elongated handle which can be grasped and manipulated by an individual, and a spoon head fixedly secured to a first end of said elongated handle, said spoon head having a substantially ellipsoidal shape, said spoon head being shaped so as to define a spoon head cavity extending along a front side of the spoon head and a longitudinal ridge extending along a back side thereof, said longitudinal ridge being oriented so as to extend substantially parallel to a longitudinal axis extending through said elongated handle;

a hammer assembly; and mounting means for coupling said hammer assembly to an end of said spoon member to support said hammer assembly relative to said spoon member.

2. The percussive spoon instrument of claim 1, wherein said hammer assembly comprises a reed arm mounted at a first end thereof by said mounting means to a second end of said elongated handle, said reed arm extending along a longitudinal length of said elongated handle and terminating at a second end of said reed arm positioned proximal to said longitudinal ridge of said spoon head; and a hammer head mounted to said second end of said reed arm.

3. The percussive spoon instrument of claim 2, wherein said spoon head is shaped so as to define a concave interior surface spaced from a convex exterior surface with said longitudinal ridge extending along and projecting from said convex exterior surface.

4. The percussive spoon instrument of claim 2, wherein said spoon head is shaped so as to define a concave interior surface continuing into a flat interior surface from which a center projection extends, and a convex exterior surface with said longitudinal ridge extending along and projecting from said convex exterior surface.

5. The percussive spoon instrument of claim 2, wherein said spoon head is shaped so as to define a concave interior surface from which a pair of eccentric projections extend with a raised center interior surface extending between said eccentric projections, and a convex exterior surface with said longitudinal ridge extending along and projecting from said convex exterior surface.

6. The percussive spoon instrument of claim 2, wherein said mounting means comprises a mounting block fixedly secured to said second end of said elongated handle, said mounting block having a semi-circular channel extending along a top surface of said mounting block in a direction parallel to said longitudinal axis of said elongated handle for receiving an end of said reed arm at least partially therewithin; and an elastic band extending about said mounting block to retain said reed arm relative to said mounting block.

7. The percussive spoon instrument of claim 2, wherein said hammer head comprises a substantially rectangular block shaped so as to define an angled tip extending substantially orthogonal to a longitudinal axis of said reed arm.

8. The percussive spoon instrument of claim 2, wherein said hammer head comprises a block shaped so as to define a semi-circular tip extending substantially orthogonal to a longitudinal axis of said reed arm.

9. The percussive spoon instrument of claim 2, wherein said hammer head comprises a blade shaped so as to define an elongated sharp edge.

10. The percussive spoon instrument of claim 2, wherein said hammer head comprises a blade shaped so as to define a pair of opposed arcuate cutouts which cooperate to define a shortened sharp edge extending along a portion of the blade.

11. The percussive spoon instrument of claim 2, and further comprising a second elongated handle projecting from said spoon head; a second hammer assembly; and a second mounting means for coupling said second hammer assembly to an end of said second elongated handle to support said second hammer assembly relative to said spoon head.

12. The percussive spoon instrument of claim 2, and further comprising a first lateral hammer assembly and a second lateral hammer assembly mounted to said elongated handle and extending substantially parallel to and along opposed sides of said hammer assembly.

13. The percussive spoon instrument of claim 2, wherein said hammer assembly is of a first longitudinal length, with said first lateral hammer assembly being of a second longitudinal length wherein said first longitudinal length is substantially greater than said second longitudinal length, and further wherein said second lateral hammer assembly is of a third longitudinal length, wherein said third longitudinal length is substantially greater than said first longitudinal length of said hammer assembly.

* * * * *